US011959732B2

(12) United States Patent
Cottrell et al.

(10) Patent No.: US 11,959,732 B2
(45) Date of Patent: Apr. 16, 2024

(54) SHOOTING TARGET TURNER

(71) Applicant: Battenfeld Technologies, Inc., Columbia, MO (US)

(72) Inventors: Michael Cottrell, Columbia, MO (US); Adam J. Birk, Hallsville, MO (US); Dennis W. Cauley, Jr., Booneville, MO (US); Timothy S. Kinney, Warrenton, MO (US); Michael Poehlman, Columbia, MO (US); James Gianladis, Harrisburg, MO (US)

(73) Assignee: AOB Products Company, Columbia, MO (US)

( * ) Notice: Subject to any disclaimer, the term of this patent is extended or adjusted under 35 U.S.C. 154(b) by 8 days.

(21) Appl. No.: 16/239,103

(22) Filed: Jan. 3, 2019

(65) Prior Publication Data

US 2020/0217628 A1 Jul. 9, 2020

(51) Int. Cl.

| | |
|---|---|
| ***F41J 7/06*** | (2006.01) |
| ***F41J 1/10*** | (2006.01) |
| *F41J 7/04* | (2006.01) |

(52) U.S. Cl.

CPC .. *F41J 7/06* (2013.01); *F41J 1/10* (2013.01); *F41J 7/04* (2013.01)

(58) Field of Classification Search

CPC . F41J 1/00; F41J 1/10; F41J 7/00; F41J 7/06; F16D 1/00; F16D 1/0882; F16D 1/0888; F16D 1/10–112; Y10T 403/7031; E01F 9/631; E01F 9/638; E01F 9/642; E01F 9/644

USPC ..... 273/359, 369, 370, 390–392, 406, 407; 403/359.3, 359.6, 361, 363

See application file for complete search history.

(56) References Cited

U.S. PATENT DOCUMENTS

| | | | | | |
|---|---|---|---|---|---|
| 2,284,510 | A * | 5/1942 | Cates | F41J 7/06 | 273/407 |
| 2,466,686 | A * | 4/1949 | Connelly | F41J 1/10 | 226/43 |
| 2,706,634 | A * | 4/1955 | Van | F41J 7/06 | 273/406 |
| 3,064,976 | A * | 11/1962 | Kuhn | A63B 63/00 | 273/369 |
| 3,348,843 | A * | 10/1967 | Stanley | F41J 7/00 | 273/406 |

(Continued)

OTHER PUBLICATIONS

Information Disclosure Statement Letter dated Sep. 6, 2019 regarding activities more than one year prior to Jan. 3, 2019, 2 pages.

*Primary Examiner* — Laura Davison
(74) *Attorney, Agent, or Firm* — Stinson LLP

(57) ABSTRACT

A target turner and associated components and methods. The target turner is configured to hold a target to be shot by a shooter. The target turner is configured to hold the target in a shooting orientation for being shot by the shooter and in a non-shooting orientation for hiding a face of the target from the user. A turning assembly of the target turner includes a crank wheel and two turning wheels. The crank wheel drives the first turning wheel for turning the target toward the non-shooting orientation and drives the second turning wheel for turning the target toward the shooting orientation. A target support of the target turner is configured to disconnect from the turning assembly to avoid damage to the turning assembly if outside force is applied to the target support.

31 Claims, 15 Drawing Sheets

(56) References Cited

U.S. PATENT DOCUMENTS

| | | | | | |
|---|---|---|---|---|---|
| 3,515,388 | A * | 6/1970 | Zachmeier | F41J 7/06 | 273/406 |
| 3,914,879 | A * | 10/1975 | Taylor, III | F41J 7/06 | 434/19 |
| 4,076,247 | A * | 2/1978 | Kim | F41J 9/02 | 273/366 |
| 4,189,147 | A * | 2/1980 | Schmid | F41J 7/02 | 273/406 |
| 4,288,080 | A * | 9/1981 | Laporte | F41J 7/06 | 273/406 |
| 5,161,794 | A * | 11/1992 | Adachi | B65H 5/062 | 271/272 |
| 7,694,973 | B1 * | 4/2010 | Hofmeister | F41J 7/06 | 273/391 |
| 7,735,832 | B2 * | 6/2010 | Bliehall | A63B 63/06 | 273/369 |
| 8,235,390 | B1 * | 8/2012 | Spikes | F41J 7/04 | 273/406 |
| 8,955,846 | B2 * | 2/2015 | Frickey | F41J 1/10 | 248/183.1 |
| 8,997,363 | B2 * | 4/2015 | Rahmanian | F41J 1/10 | 273/406 |
| 2010/0013162 | A1 * | 1/2010 | Wright | F41J 7/06 | 273/406 |
| 2010/0225062 | A1 * | 9/2010 | Shum | F41J 7/06 | 273/359 |

* cited by examiner

SHOOTING TARGET TURNER

FIELD

The present disclosure generally relates to shooting accessories, and more particularly to a turner for turning a shooting target.

BACKGROUND

Firearms shooters shoot at various types of targets for practicing their shooting skills. Sometimes mechanical target assemblies are used to present and hide a target from the shooter. Some mechanical target assemblies are referred to as target turners. In one example, the target turner supporting a shooting target turns the target between an orientation in which the target faces the shooter and an arrangement in which the target does not face the shooter. Conventional target turners are relatively expensive because of the costly internal components (e.g., stepper motor).

SUMMARY

In one aspect, a target turner comprises a target support including a target holder configured to hold a target. The target turner includes a base configured to engage a support surface and to support the target with respect to the support surface. The target support is rotatable with respect to the base about a target turning axis. The target turner includes a turning assembly supported by the base and operatively connectable to the target support for turning the target support about the target turning axis. The turning assembly includes a motor and a drive train. The motor includes an output shaft operatively connected to the drive train. The motor is configured to rotate the output shaft in a first direction of rotation. The drive train is configured to, in response to rotation of the output shaft in the first direction of rotation, turn the target support in a first turning direction about the target turning axis from a non-shooting orientation to a shooting orientation and to, in response to further rotation of the output shaft in the first direction of rotation, turn the target support in a second turning direction opposite the first turning direction about the target turning axis from the shooting orientation to the non-shooting orientation.

In another aspect, a target turner comprises a target support configured to hold a target. The target support includes a post having a lower end. The target turner includes a base configured to engage a support surface and to support the target support for supporting the target with respect to the support surface. The target turner includes a turning assembly supported by the base and operatively connectable to the target support to apply a turning force to the target support to turn the target support about a target turning axis. The turning assembly includes a target support connector for connecting the target support to the turning assembly. At least one of the lower end of the post and the target support connector of the turning assembly comprises a protrusion. The other of the at least one of the lower end of the post and the target support connector of the turning assembly comprises a recess. The protrusion is receivable in the recess to form a joint for connecting the target support to the turning assembly for conjoint turning of the protrusion and recess in response to the turning force applied by the turning assembly. The recess and protrusion are configured to dislocate the joint to disconnect the target support and turning assembly in response to a force applied to the target support in opposition to the turning force.

In yet another aspect, a target stand comprises a target support configured to hold a target, the target support includes a post and a first target support arm. The target support arm has a connection portion at which the target support arm bends between a first arm segment and a second arm segment. The post includes a socket in which the connection portion of the target support arm is receivable. The socket includes a first section arranged to receive the first arm segment and includes a second section arranged to receive the second arm segment. The socket includes a detent arranged to engage the second arm segment when the second arm segment is received in the second section of the socket.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
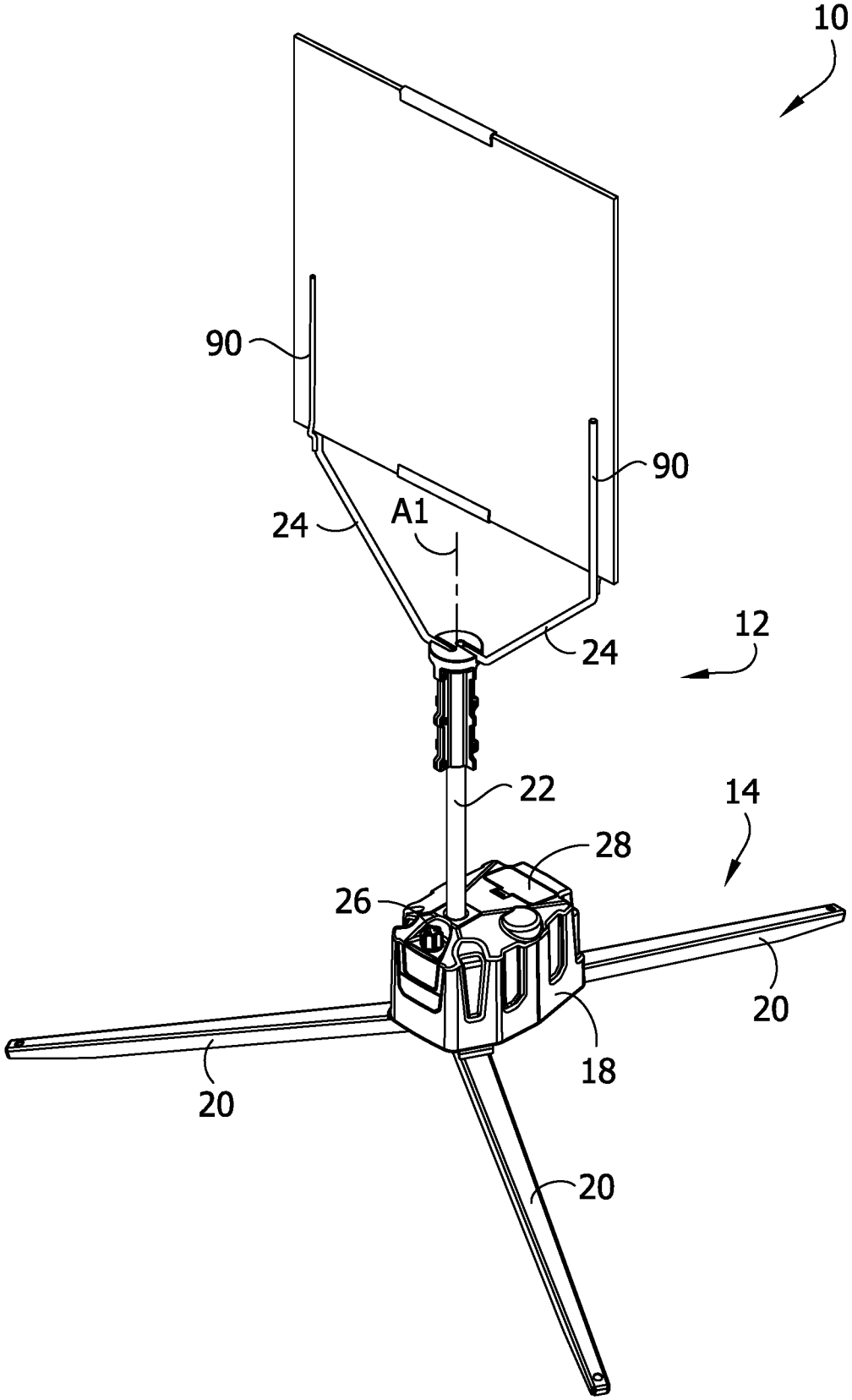
FIG. 1 is a perspective of a target turner embodying aspects of the present disclosure.

Referring to FIG. 1, a target turner embodying aspects of the present disclosure is indicated generally by the reference number 10. The target turner can be used to hold a shooting target and for turning the target to alternately "present" the target to a shooter and to "hide" the target from the shooter. The target turner 10 is shown in a "presenting" or "shooting" configuration in FIG. 1. When the target is presented to the shooter, the target faces the shooter so the shooter can view a face of the target and aim at and shoot at the target. The target turner 10 is shown in a "hiding" or "non-shooting" configuration in FIG. 2 in which the target is turned about 90 degrees ("about" meaning plus or minus 10 degrees) with respect to the shooting configuration. When the target is hidden from the shooter, the face of the target faces laterally (to the right) with respect to the shooter such that a side edge of the target is oriented toward the shooter. The target being intermittently presented to the shooter provides the shooter with a limited time to detect presentation of the target, and to aim at and shoot at the target while the target is facing the shooter. This can be used as a training aid for shooting effectively and quickly when provided limited time to detect and aim at a target. Desirably, the turning of the target from the non-shooting orientation to the shooting orientation happens relatively quickly, and the target is held stationary for a period of time. Then the target is turned back relatively quickly to the non-shooting orientation and held there for a period of time.

The target turner 10 includes a target support 12, a base 14 for supporting the target support, and a turning assembly 16 (FIG. 3) supported by the base and operatively connected to the target support for turning the target support about an axis of rotation A1. In the illustrated embodiment, the base 14 includes a housing 18 that houses the turning assembly 16. The base 14 also includes three legs 20 configured as a tripod to engage a support surface such as a ground surface or floor surface. In other embodiments, the base may be configured to engage an elevated or overhead support surface, such as when the target turner is to be inverted. The target support 12 includes a post 22 having a lower end connected to the turning assembly 16. The target support 12 also includes two target support arms 24 extending from an upper end of the post 22.

An actuator in the form of an on/off and control knob 26 is provided on an upper surface of the housing 18 for turning the target turner 10 on/off and for adjusting a speed at which the target turner operates. A battery door 28 is provided at a rear, upper surface of the housing 18 and closes a battery compartment in the housing. The target turner 10 can be powered by batteries 30 (e.g., eight AA batteries) or can be powered by plugging a power cord (not shown) of the target turner into an electrical outlet. Other types of power sources can be used without departing from the scope of the present invention.

Figure 3:
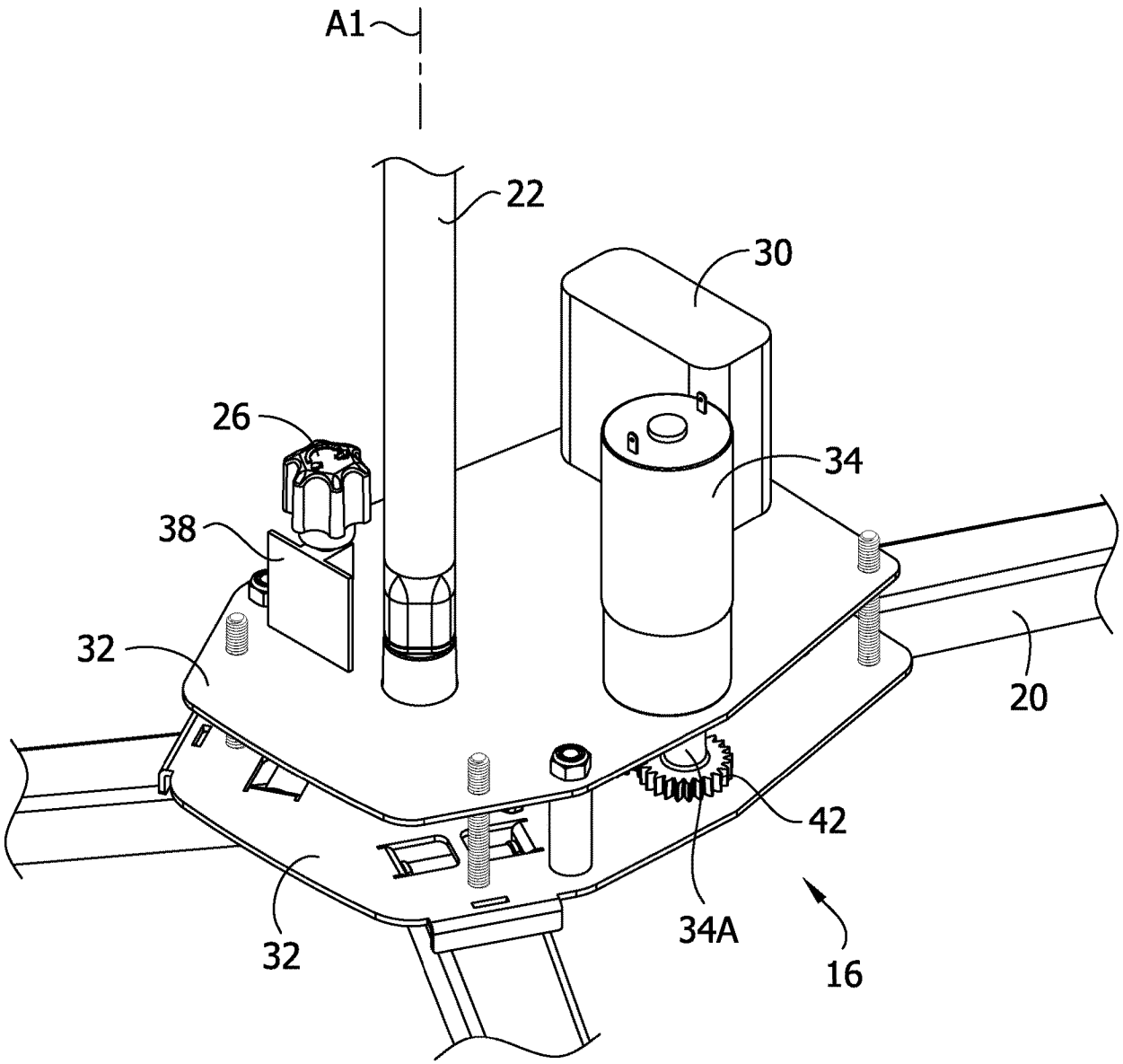
FIG. 3 is a fragmentary, enlarged view of a lower portion of the target turner with a housing removed to show internal components, including a motor and a drive train.
Figure 4:
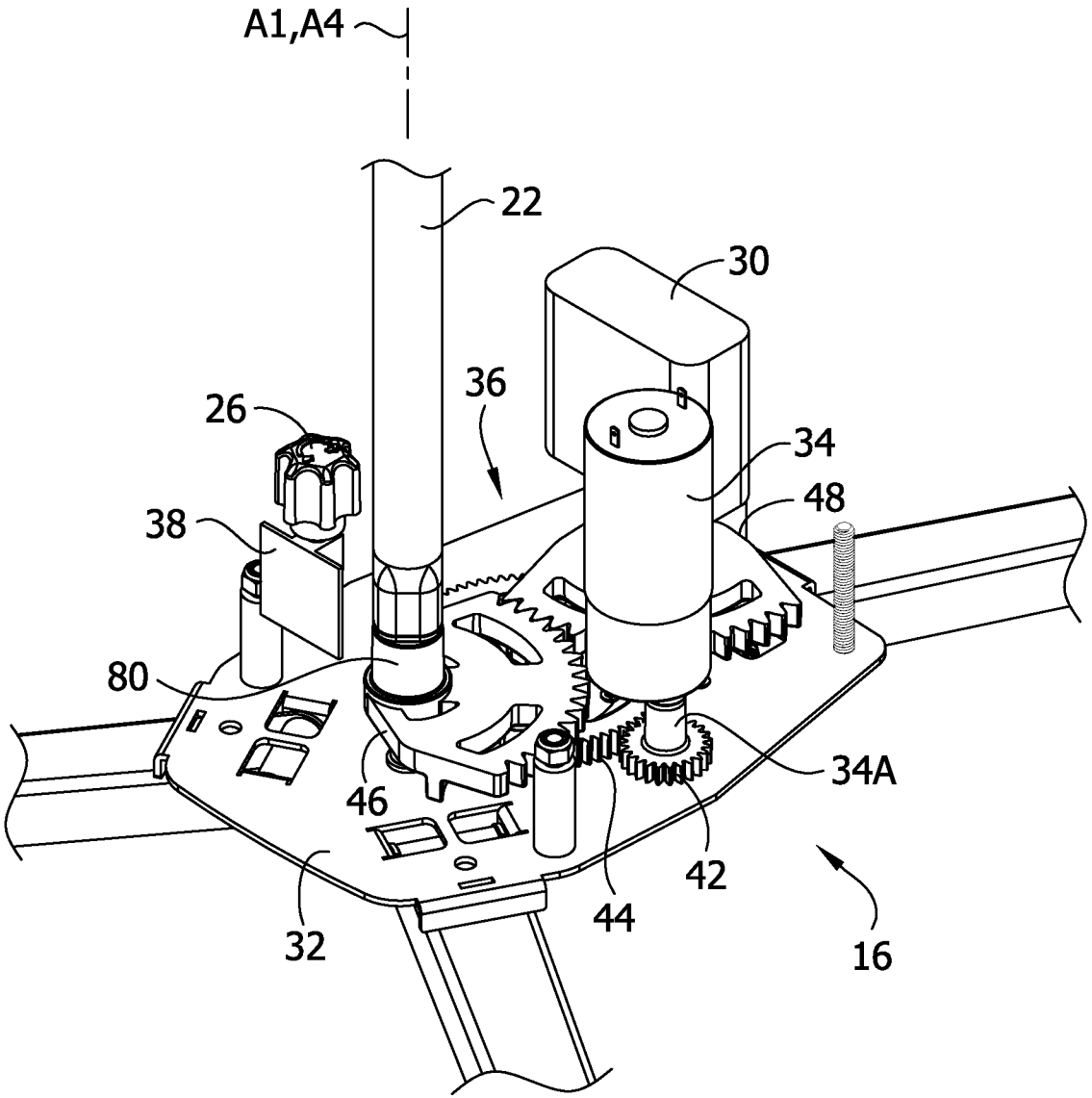
FIG. 4 is a view similar to FIG. 3 further removing an upper mounting plate.

Referring to FIGS. 3 and 4, the turning assembly 16 is supported by first and second mounting plates 32. The turning assembly 16 includes a motor 34 (e.g., 12V DC motor) and a drive train 36 operatively connected to the motor. The motor 34 includes a rotary output shaft 34A or drive shaft configured to rotate in a single direction (e.g., clockwise). The motor 34 is in electrical communication with the power source (e.g., battery pack 30) for powering the motor. Electrical power to the motor 34 is controlled by a controller 38 to which the actuator 26 is connected. For example, the controller 38 can include a rheostat, more desirably a PWM (pulse width modulation) controller, a relatively simple on/off switch, or another suitable controller. In the case of a rheostat or PWM controller 38, rotation of the knob 26 in a first direction (e.g., clockwise) first turns the motor 34 on, and further rotation of the knob increases the speed at which the motor operates to increase a speed at which the target turner 10 operates. Turning the knob 26 in a second direction opposite the first direction (e.g., counter-clockwise) reduces the speed at which the motor 34 operates, and further turning of the knob in the second direction ultimately turns the motor off. Suitable wiring (not shown) can be used for providing electrical communication among the power source 30, controller 38, and motor 34.

The lower mounting plate 32 forms a lower surface of the housing 18. The legs 20 are pivotally connected to the lower mounting plate 32 and are pivotable between deployed positions (FIG. 1) and stowed positions (not shown) in which the legs extend generally alongside each other to make the turner 10 more compact for storage.

Referring to FIG. 4, the drive train 36 is operatively coupled to the motor drive shaft 34A. The drive train 36 includes a relatively small drive gear 42 (broadly, "drive wheel") mounted on the drive shaft 34A and a turning wheel mechanism. The drive gear 42 has a plurality of gear teeth in mesh with a plurality of teeth of a crank gear 44 (broadly, "crank wheel"). Rotation of the crank gear 44 (e.g., in a counter-clockwise direction) drives movement of first and second turning wheels 46, 48 (broadly, "turning wheels" or "turning members" or "turning bodies"). The target support 12 is mounted to the first turning wheel 46. As will become apparent, the crank gear 44 is configured to drive the first turning wheel 46 to turn the target support 12 in a clockwise direction to the shooting orientation to face forward toward the shooter, and the crank gear 44 is configured to drive the second turning wheel 48 to turn the target support 12 in a counter-clockwise direction to the non-shooting orientation. As explained in further detail below, and as shown in FIGS. 10A to 10D, continuous clockwise rotation of the crank gear 44 alternately and intermittently drives the first and second turning wheels 46, 48 to turn the target back and forth. The first and second turning wheels 46, 48 are in mesh with each other such that the wheels turn conjointly and in inverse directions. When the first turning wheel 46 is driven clockwise by the crank gear 44 to turn the target to face the shooter, the second turning wheel 48 is driven counter-clockwise by the first turning wheel. When the second turning wheel 48 is driven clockwise by the crank gear 44, the second turning wheel drives the first turning wheel 46 counter-clockwise for turning the target to the non-shooting orientation. It will be appreciated that the crank wheel 44 could be driven directly by the motor instead of indirectly via the drive gear 42 without departing from the scope of the present invention.

Figure 5:
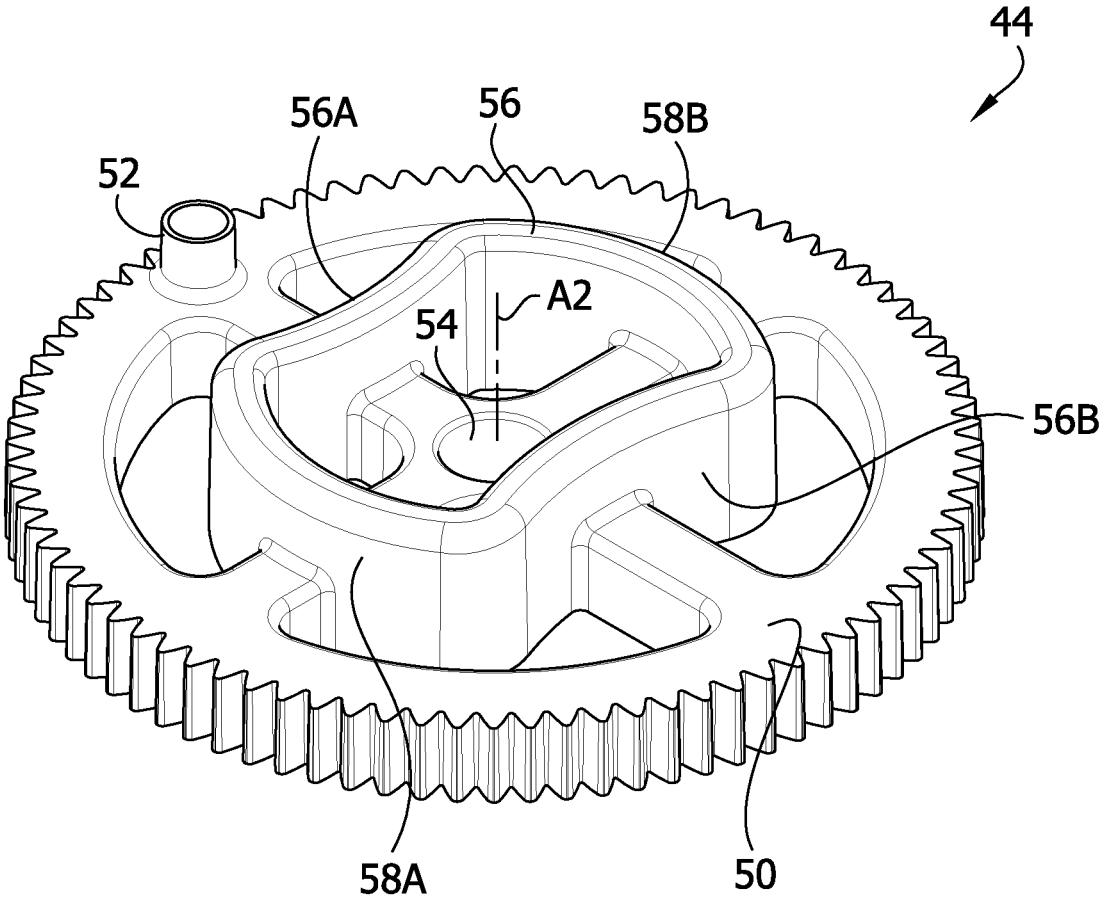
FIG. 5 is a top perspective of a crank wheel of the drive train.

Referring to FIG. 5, the crank gear 44 includes a crank gear body 50 having the plurality of gear teeth around a periphery of the crank gear body. A protrusion 52 (broadly, "turning wheel actuator") in the form of a cylindrical stud extends upward from the crank gear body 50. The crank gear 44 includes a central opening 54 for reception over a shaft mounted to the lower mounting plate 32 that defines a rotational axis A2 of the crank gear. The crank gear 44 includes a lock structure 56 protruding upward from the crank gear body 50. The lock structure 56 is configured to lock the turning wheels 46, 48 in position through two segments of the crank wheel's rotational travel. The lock structure 56 is configured to unlock the turning wheels 46, 48 through two other segments of the crank wheel's rotational travel between the locking segments of the crank wheel's rotational travel. The locking and unlocking of the turning wheels 46, 48 will be explained in further detail below with respect to FIGS. 10A to 10D. The lock structure 56 defines two concave "non-locking" surfaces 56A, 56B opposite each other and facing laterally with respect to the rotational axis A2. The lock structure 56 also defines two convex "locking" surfaces 58A, 58B opposite each other and facing laterally with respect to the rotational axis A2. The turning wheel actuator 52 is located on the crank wheel body 50 radially outboard of one of the concave non-locking surfaces 56A from the rotational axis A2.

Figure 6:
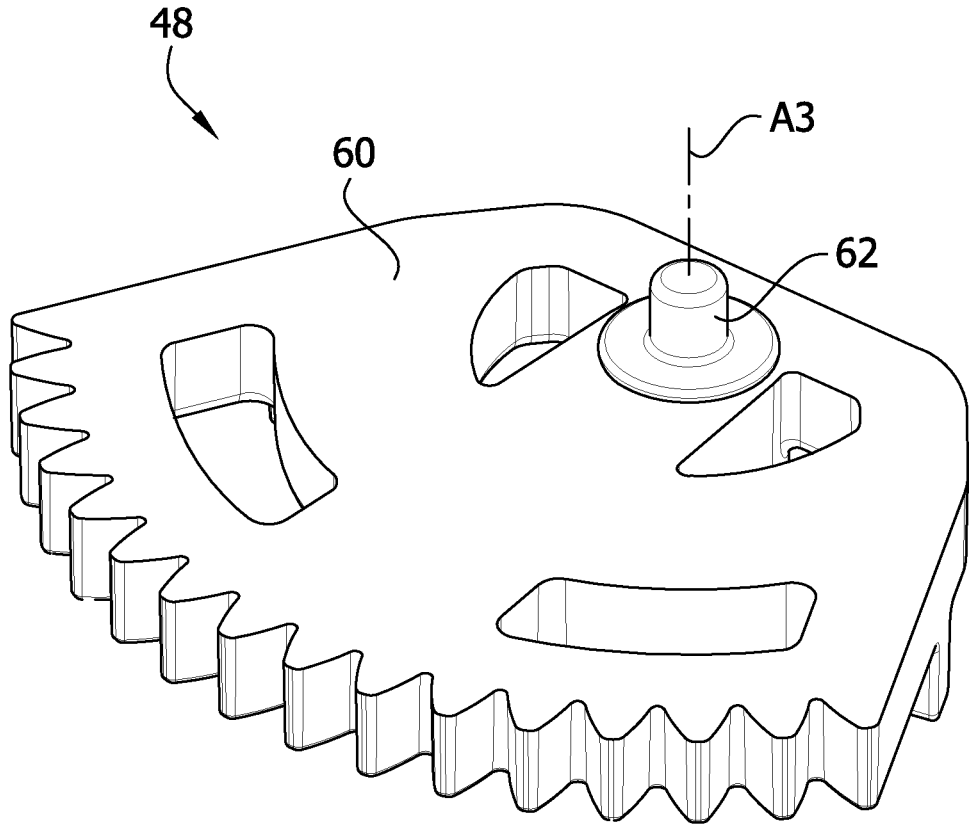
FIG. 6 is a top perspective of a first turning wheel of the drive train.
Figure 7:
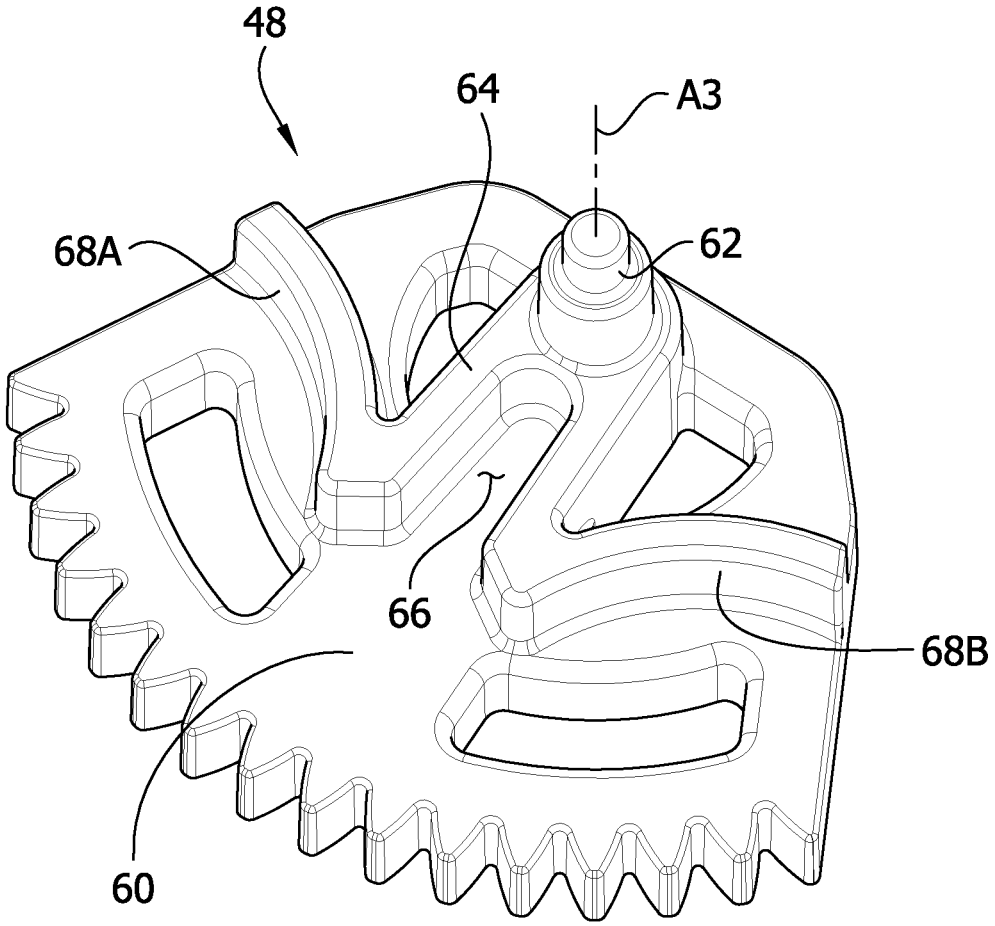
FIG. 7 is a bottom perspective of the first turning wheel.

Referring to FIGS. 6 and 7, the second turning wheel 48 includes a turning wheel body 60 having a section of gear teeth extending along an arcuate peripheral segment of the turning wheel body. A pin 62 protruding from a bottom of the turning wheel body 60 is receivable in the lower mounting plate 32 and defines a pivot axis A3 of the second turning wheel 48. A crank wheel engagement structure 64 extends downward from the turning wheel body 60. The crank wheel engagement structure 64 has a generally W shape including an intermediate portion defining a drive slot 66 and two arms defining respective concave lock engagement surfaces 68A, 68B. As will become apparent, the drive slot 66 interfaces with the turning wheel actuator 52 of the crank gear 44 to drive pivoting of the second turning wheel 48 by the crank gear, and the lock engagement surfaces 68A, 68B interface with the convex locking surfaces 58A, 58B of the lock structure 56 for holding the second turning wheel 48 in position when it is not being driven directly by the crank gear 44 or indirectly by the crank gear via the first turning wheel 46.

Figure 8:
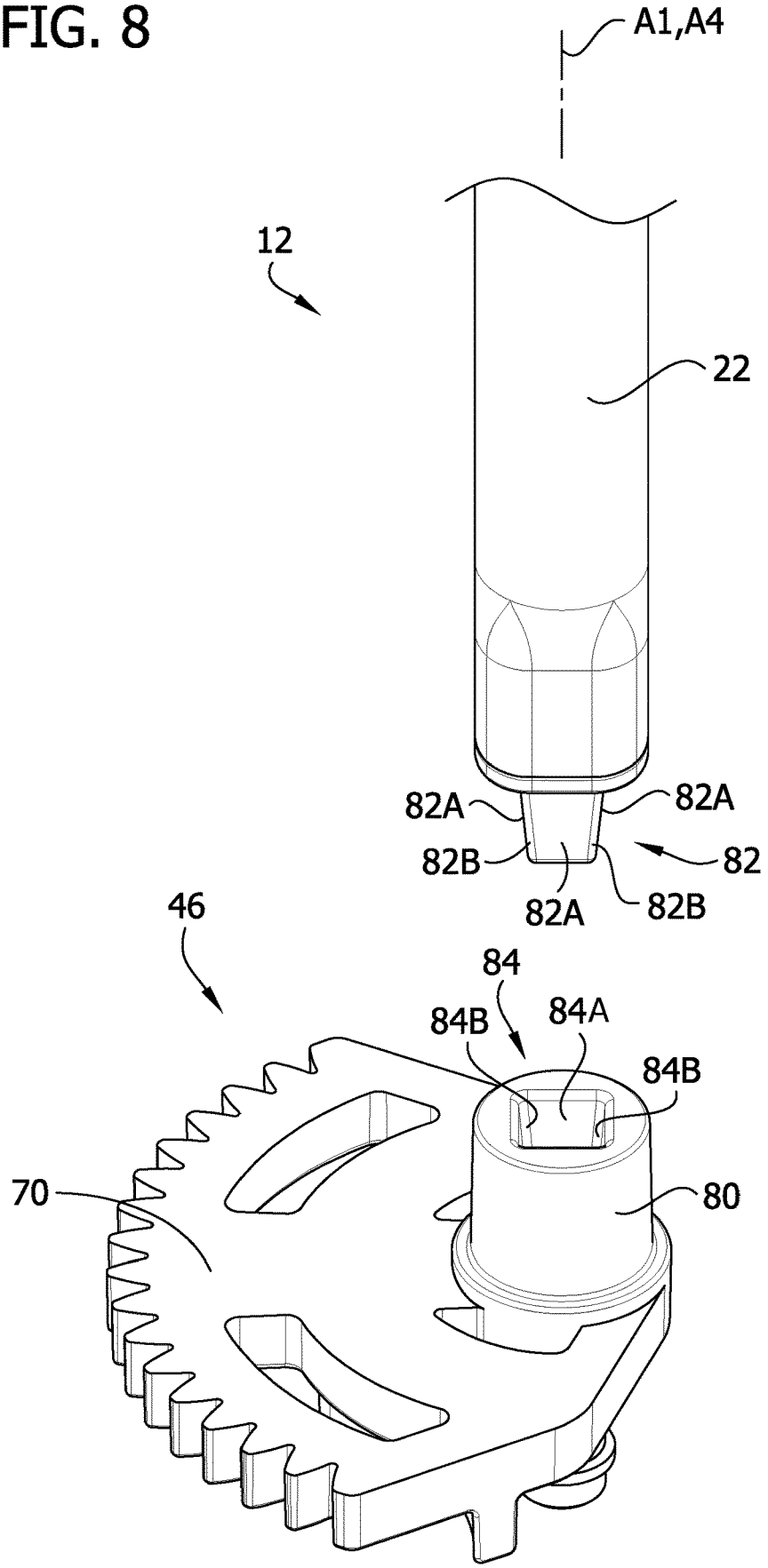
FIG. 8 is a top perspective of a second turning wheel with a lower end of a post of the target support.
Figure 9:
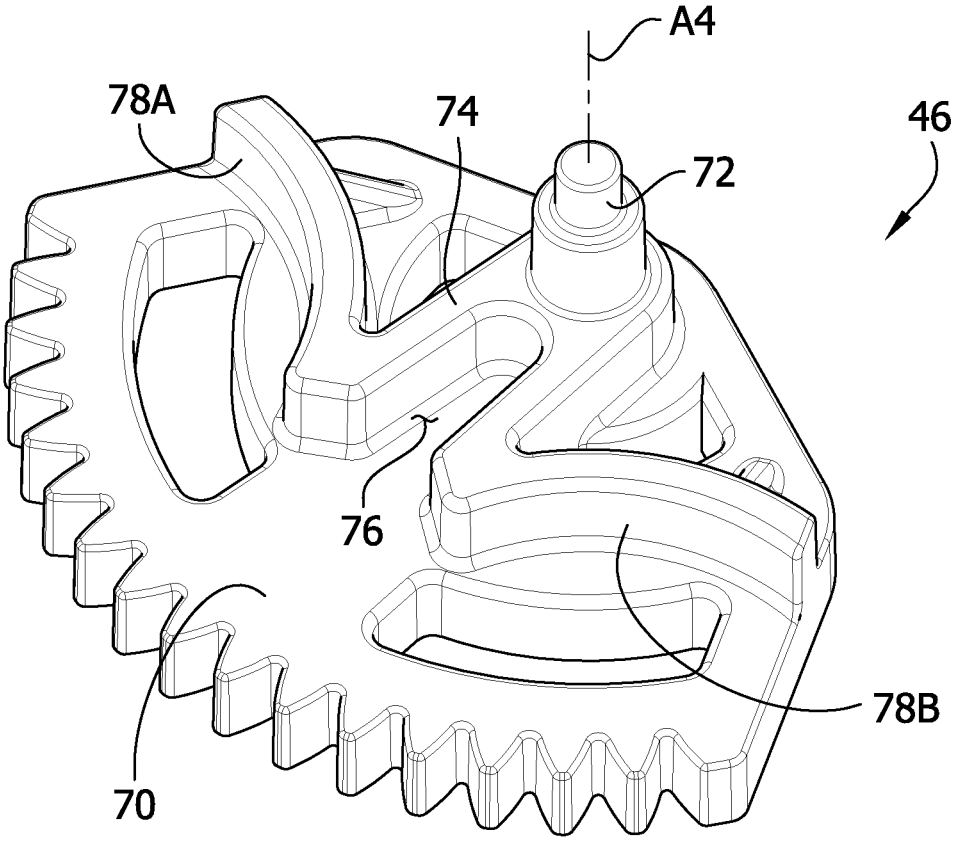
FIG. 9 is a bottom perspective of the second turning wheel.

Referring to FIGS. 8 and 9, the first turning wheel 46 includes a turning wheel body 70 having a section of gear teeth extending along an arcuate peripheral segment of the turning wheel body. A pin 72 protruding from a bottom of the turning wheel body 70 is receivable in the lower mounting plate 32 and defines a pivot axis A4 of the first turning wheel. A crank wheel engagement structure 74 extends downward from the turning wheel body 70. The crank wheel engagement structure 74 has a generally W shape including an intermediate portion defining a drive slot 76 and two arms defining respective concave lock engagement surfaces 78A, 78B. As will become apparent, the drive slot 76 interfaces with the turning wheel actuator 52 of the crank gear 44 to drive pivoting of the first turning wheel 46 by the crank gear, and the lock engagement surfaces 78A, 78B interface with the convex locking surfaces 58A, 58B of the lock structure 56 for holding the first turning wheel 46 in position when it is not being driven directly by the crank gear or indirectly by the crank gear via the second turning wheel 48.

Referring again to FIG. 8, a target support connector 80 extends upward from the turning wheel body 70 for connecting the target support 12 to the first turning wheel 46 and thus to the turning assembly 16. The lower end of the post 22 includes a connecting protrusion 82 receivable in a recess 84 of the target support connector to form a joint for connecting the target support 12 to the turning assembly 16. The protrusion 82 and recess 84 are configured to mate in a way that the joint causes conjoint turning of the protrusion and recess in response to turning of the first turning wheel 46. It will be appreciated that sometimes the target support 12 may encounter force or an obstruction (e.g., wind or inadvertent contact with a person or object) tending to resist rotation about the axis A1 driven by the turning assembly 16. Accordingly, the connection of the target support 12 to the turning assembly 16 is configured to permit the joint to dislocate to prevent damage to the turning assembly. In particular, the protrusion 82 and recess 84 are configured to cause at least partial ejection of the protrusion from the recess to permit the target support connector 80 to turn in the direction it is driven by the turning assembly 16 while the target support 12 turns in an opposite direction, remains relatively stationary, falls over, etc.

In the illustrated embodiment, the protrusion 82 has four generally planar sides 82A and rounded edges 82B connecting the sides. The planar sides 82A taper inward toward a longitudinal axis of the protrusion (coincident with the rotational axis A1) as the protrusion extends distally to a free end of the protrusion. Accordingly, a transverse cross-sectional area of the protrusion 82 decreases as the protrusion extends distally. The recess 84 has a corresponding shape for mating with the protrusion 82. The recess 84 includes four generally planar side walls 84A and rounded corners 84B connecting the side walls. The recess 84 tapers to become narrower as the recess extends further into the connector 80. The arrangement is such that the side walls 82A of the protrusion 82 rest in flatwise engagement with the side walls 84A of the recess 84, and the rounded edges 82B nest in the rounded corners 84B, when the protrusion is received in the recess. The fit of the protrusion 82 in the recess 84 couples the target support 12 to the first turning wheel 46 for conjoint turning with the first turning wheel. However, when the target support 12 encounters sufficient force tending to prevent the target support from turning conjointly with the first turning wheel 46, the engagement of the protrusion 82 and recess 84 (e.g., tapered mating engagement and rounded edges/corners) promotes at least partial ejection of the protrusion from the recess to permit the first turning wheel to turn with respect to the target support. After the force preventing the conjoint rotation subsides, the protrusion 82 may fall back into conjoint rotational mating engagement with the first turning wheel 46. Although the protrusion 82 is shown on the target support 12 and the recess 84 is shown on the first turning wheel 46, it will be appreciated that the arrangement could be reversed without departing from the scope of the present invention.

Figure 2:
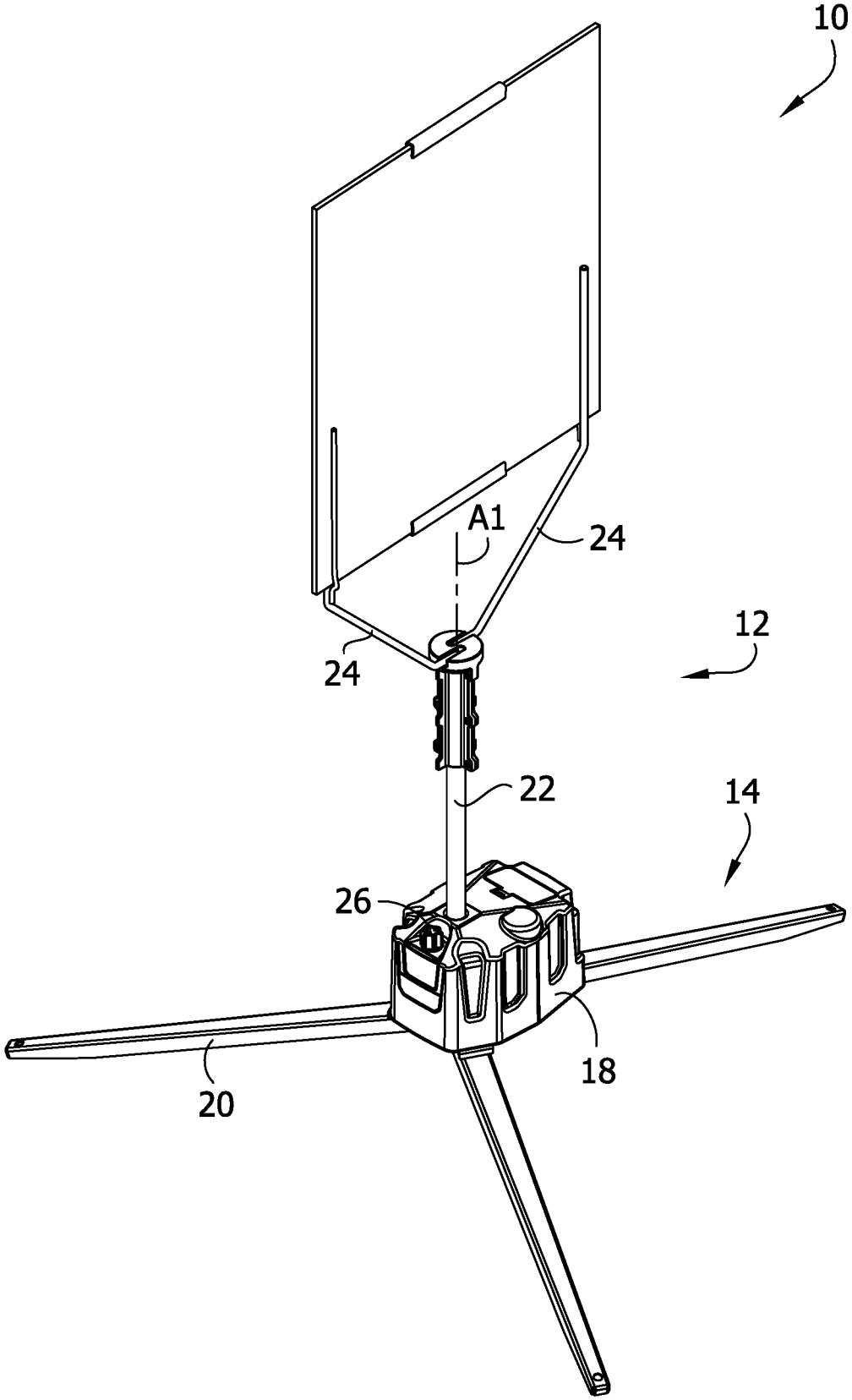
FIG. 2 is a view similar to FIG. 1 but showing a target support and supported target turned 90 degrees with respect to a base of the target turner.
Figure 10A:
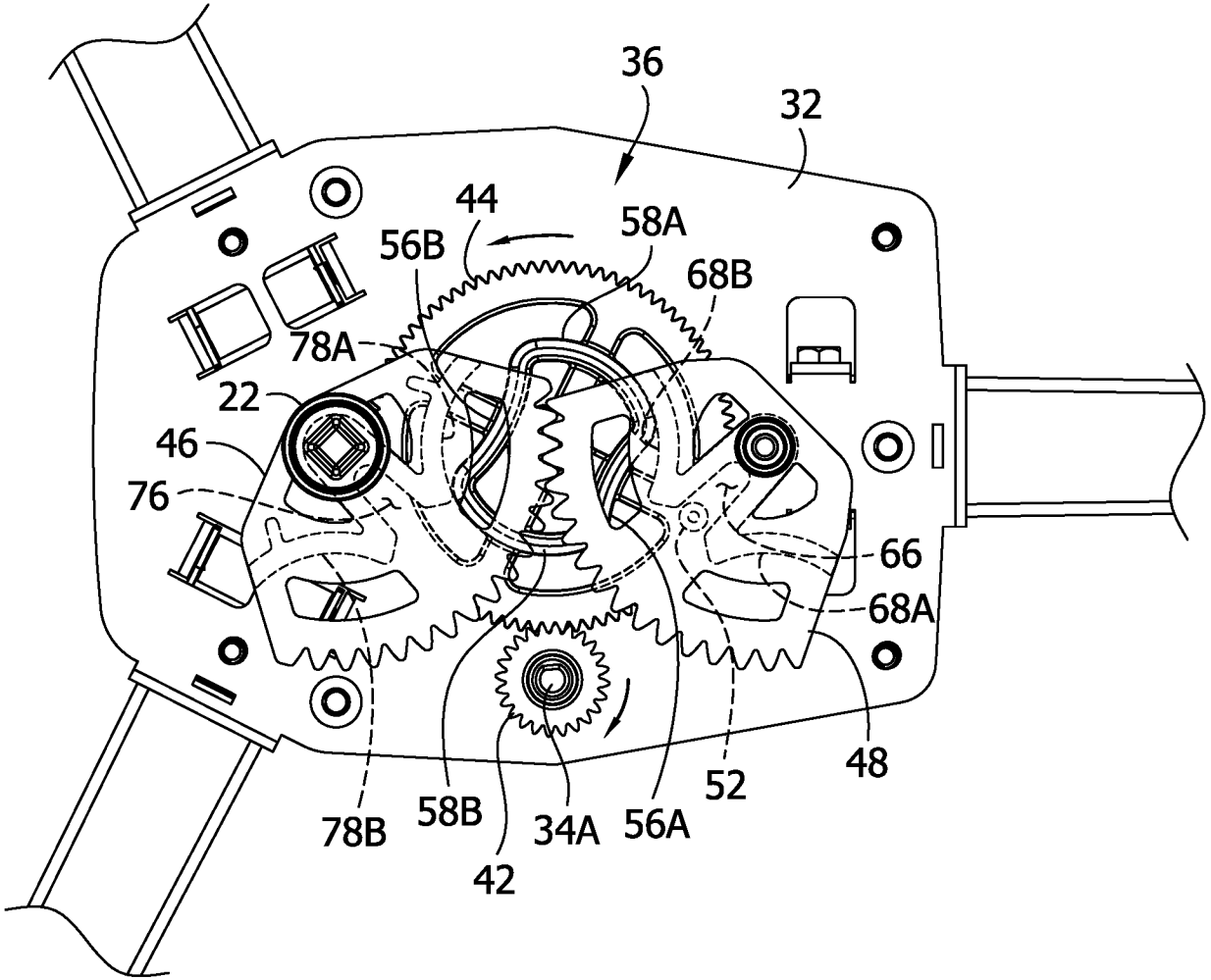
FIGS. 10A-10D are top views of the drive train illustrating a sequence of movement of the drive train to turn the target from a shooting orientation to a non-shooting orientation and back to the shooting orientation.

Operation of the target turner 10 will now be explained with reference to FIGS. 10A to 10D by description of a sequence of turning the target support 12 from the shooting orientation shown in FIG. 1 to the non-shooting orientation shown in FIG. 2, and back to the shooting orientation. In this process, the drive shaft 34A of the motor 34 and thus the drive gear 42 continuously turn in a clockwise direction at a speed set by the controller 38. Referring now to FIG. 10A, the first turning wheel 46 is shown turned to its clockwise-most orientation, and the second turning wheel 48 is shown turned to its counter-clockwise-most orientation. The turning wheel actuator 52 of the crank gear 44 is shown entering the drive slot 66 of the second turning wheel. The locking surfaces 58A, 58B of the lock structure 56 are shown in locking position with respect to the first and second turning wheels 46, 48 for obstructing respective lock engagement surfaces 68B, 78A of the turning wheels. It will be appreciated that the first and second turning wheels 46, 48 are mounted for turning about the respective turning axes A4, A3, and the turning axes are located on opposite sides of and equidistant from the crank wheel axis A2.

Figure 10B:
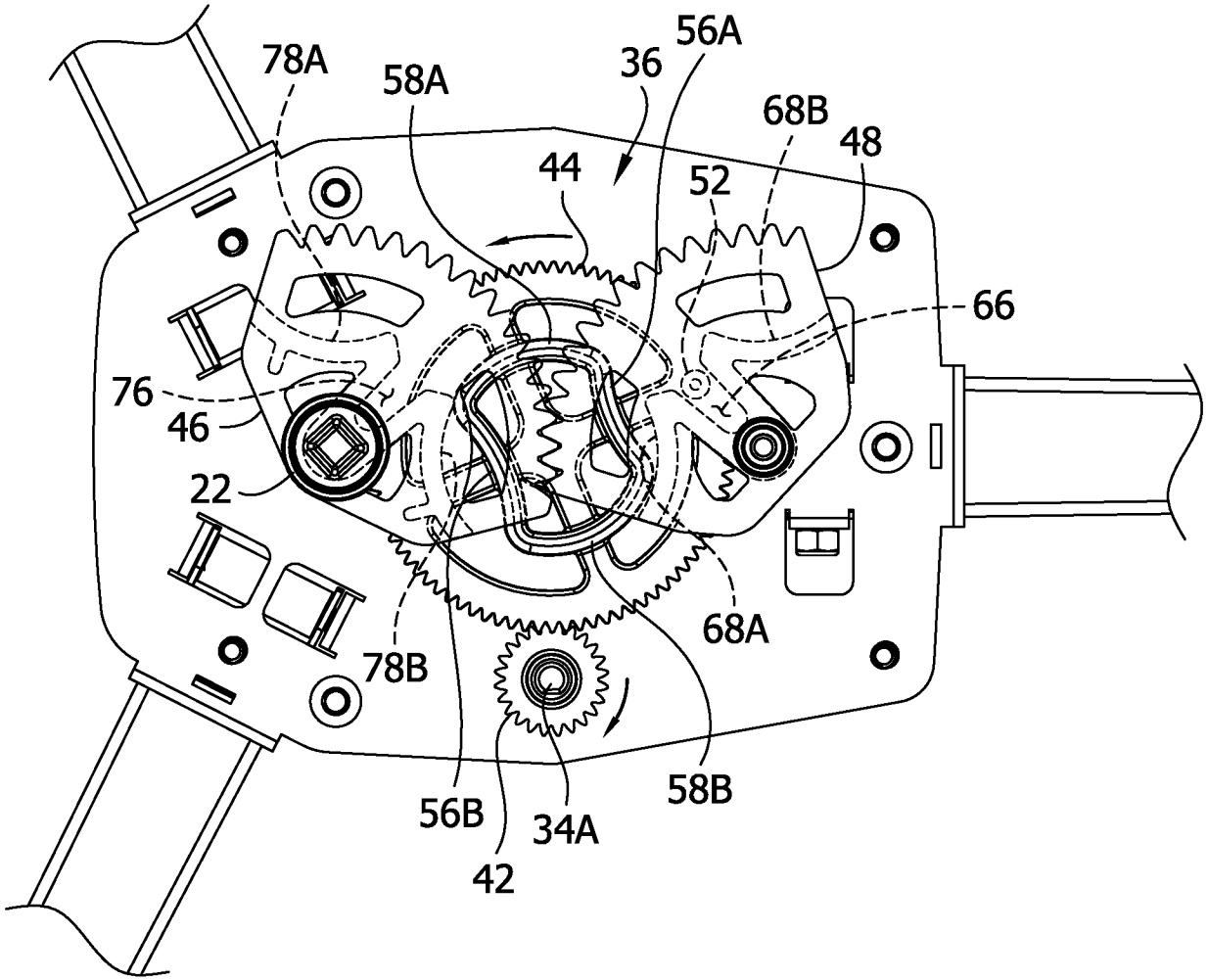

As the crank gear 44 continues to rotate in the counter-clockwise direction, from the orientation of the crank gear shown in FIG. 10A to the orientation shown in FIG. 10B, the turning wheel actuator 52 moves further into the drive slot 66 of the second turning wheel 48. At the same time, the locking surfaces 58A, 58B of the lock structure 56 rotate out of locking position with respect to the lock engagement surfaces 68B, 78A of the first and second turning wheels 46, 48, permitting the turning wheels to turn. Further rotation of the crank gear 44 causes the turning wheel actuator 52 to drive the second turning wheel 48 clockwise. The meshed engagement of the second and first turning wheels 48, 46 causes the second turning wheel to drive counter-clockwise turning of the first turning wheel, and thus turning of the target support 12 to the non-shooting orientation. During this time, the lock structure 56 is oriented such that the non-locking surfaces 56B, 56A face the respective first and second turning wheels 46, 48, permitting the turning wheels to turn without obstruction by the lock structure. It will be appreciated that the full turning of the target support 12 happens relatively suddenly.

Referring to FIG. 10B, the turning wheel actuator 52 is shown about to exit the drive slot 66 of the second turning wheel 48. As the turning wheel actuator 52 exits the drive slot 66, the locking surfaces 58A, 58B of the lock structure 56 turn into locking position with respect to the lock engagement surfaces 78B, 68A of the first and second turning wheels 46, 48. The engagement of the locking surfaces 58A, 58B with the lock engagement surfaces 78B, 68A holds the target support 12 in position against wind or other outside forces. The turning wheels 46, 48 do not move even though the locking surfaces 58A, 58B move along the locking engagement surfaces 78B, 68A. As shown by comparison of FIGS. 10B and 10C, the turning wheels 46, 48 and thus the target support 12 remain stationary for a "dwell time" during which the drive gear 42 and crank gear 44 continue to rotate.

Figure 10C:
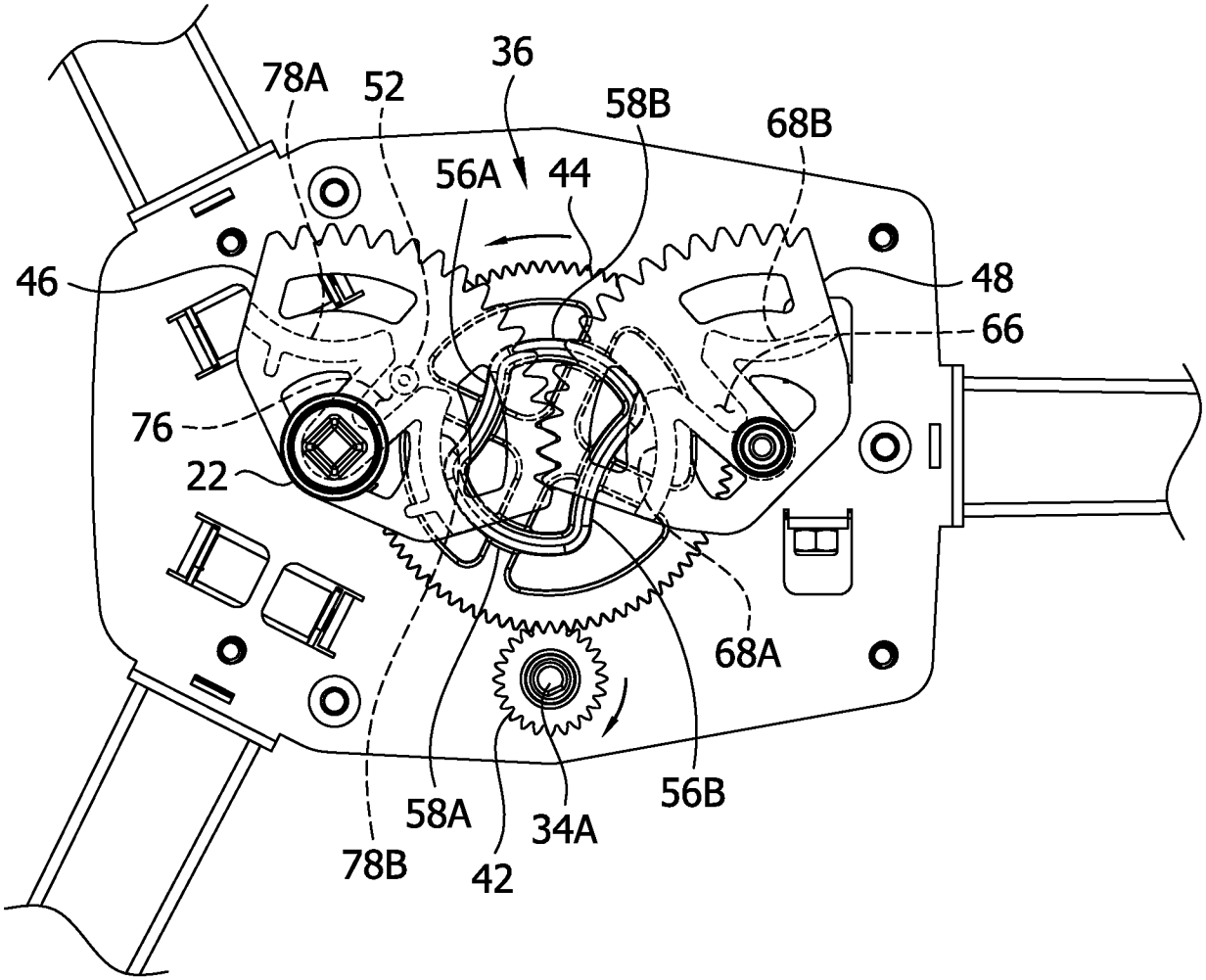
Figure 10D:
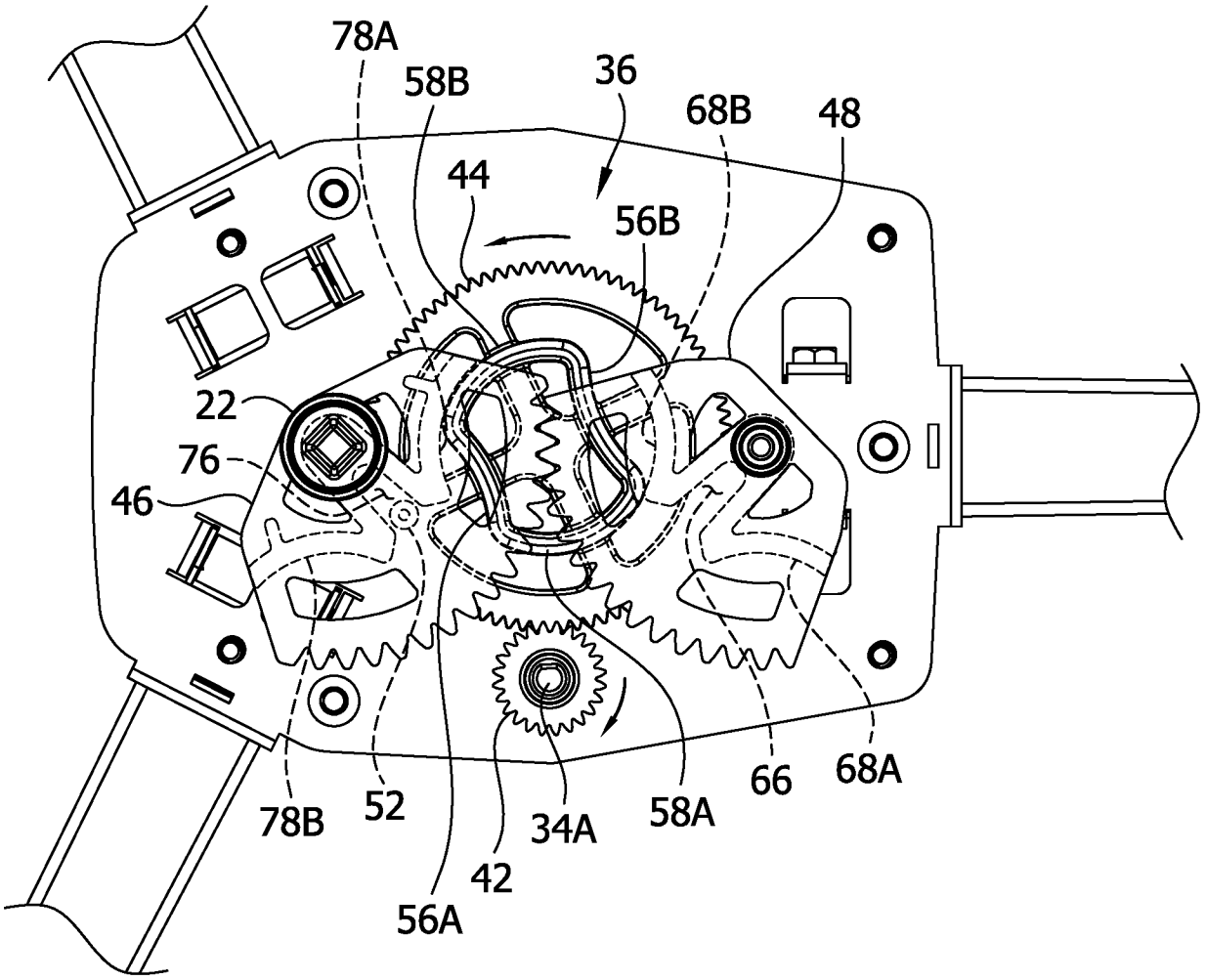

In FIG. 10C, the turning wheel actuator 52 is shown entering the drive slot 76 of the first turning wheel 46. As the turning wheel actuator 52 moves further into the drive slot 76, the locking surfaces 58A, 58B of the lock structure 56 move out of locking position with respect to the lock engagement surfaces 78B, 68A of the first and second turning wheels 46, 48. Further rotation of the crank gear 44 causes the turning wheel actuator 52 to drive clockwise turning of the first turning wheel 46 to the orientation shown in FIG. 10D, and thus turning of the target support 12 from the non-shooting orientation to the shooting orientation (FIG. 2 to FIG. 1). It will be appreciated that the turning of the target support 12 happens relatively quickly. The meshed engagement of the first turning wheel 46 with the second turning wheel 48 causes counter-clockwise rotation of the second turning wheel to reset the second turning wheel for subsequent actuation by the turning wheel actuator 52 upon further rotation of the crank gear 44 to the orientation shown in FIG. 10A.

The sequence illustrated in FIGS. 10A to 10D is repeated until the motor 34 is turned off. The target support 12 is repeatedly turned between the shooting and non-shooting orientations to provide repeated opportunities for the shooter to practice rapidly detecting the presentation of, aiming at, and shooting at the target. The knob 26 can be rotated to change the controller setting to increase or decrease the speed of the motor 34. A slower motor speed results in longer dwell periods between turning periods. The turning periods happen relatively rapidly no matter the setting of the controller. The perception of the shooter is that the dwell period or lag time between turning of the target is increased or decreased by increasing or decreasing the speed of the motor 34. Desirably, the speed setting can be chosen to provide a range of speeds in which the turning assembly 16 maintains the target support 12 in the shooting orientation for a duration of time greater than one half second and less than ten minutes. Other time durations can be used without departing from the scope of the present invention.

Figure 11:
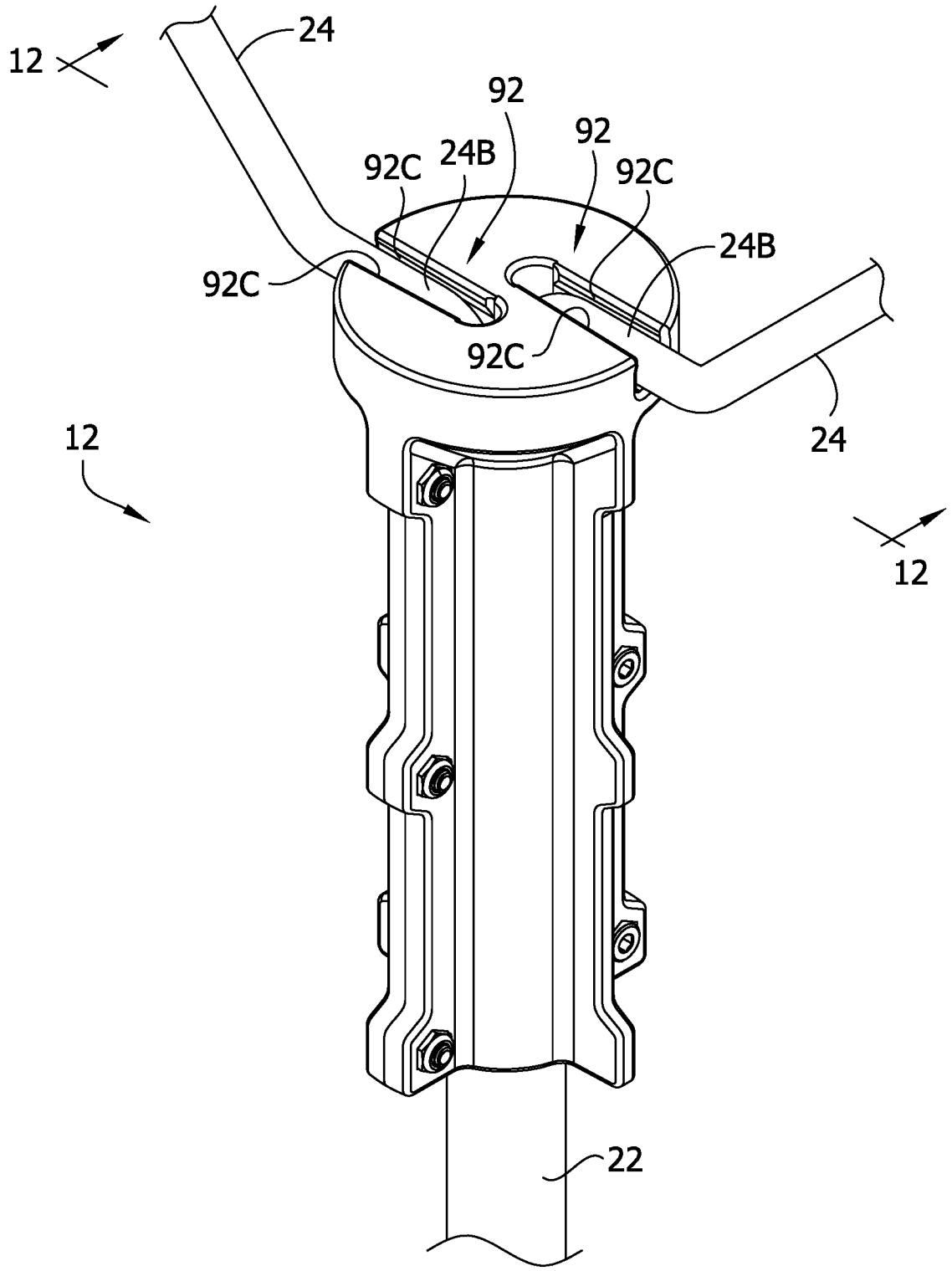
FIG. 11 is an enlarged, fragmentary perspective of an upper end of a pole of the target support and lower ends of target support arms of the target support.
Figure 12:
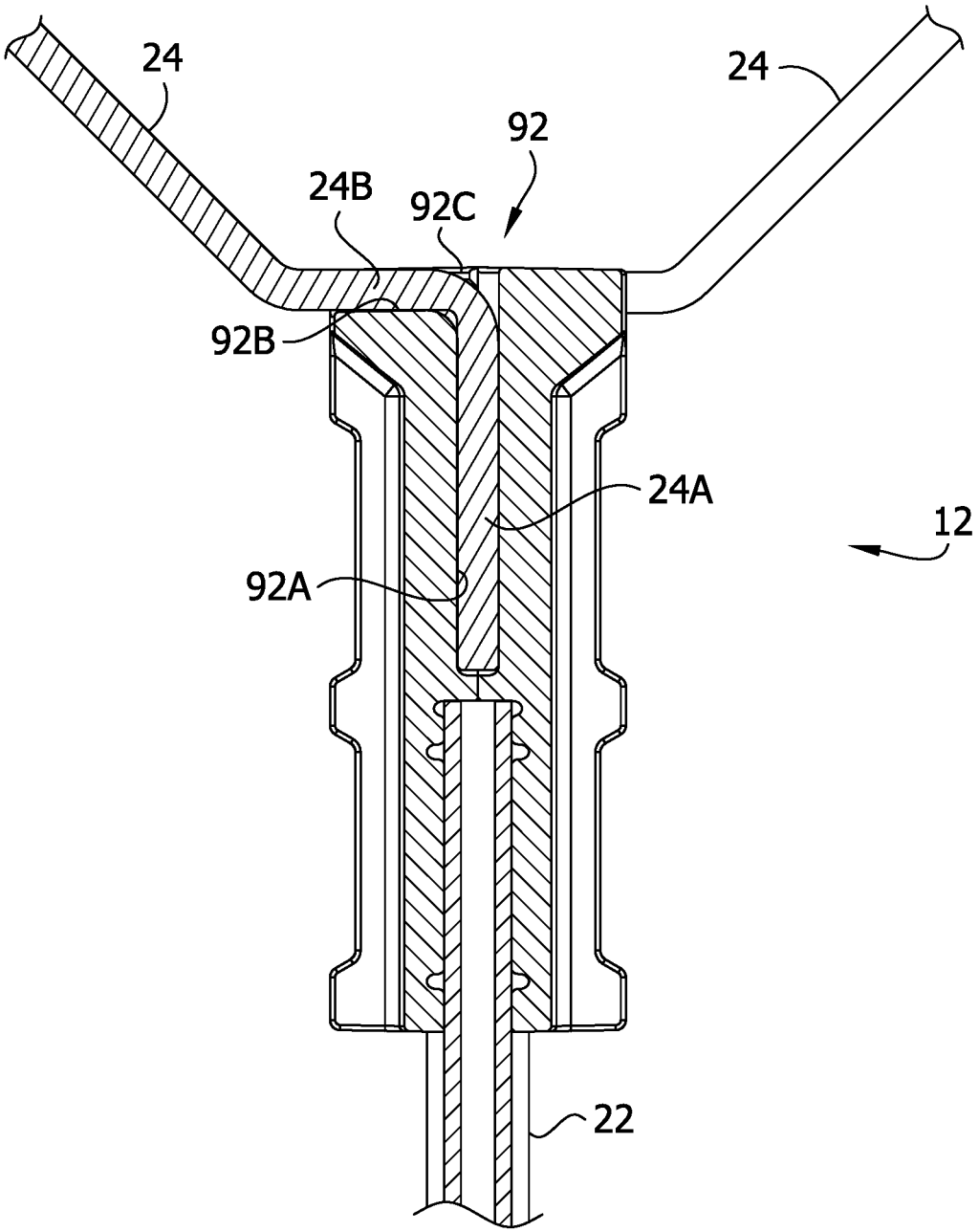
FIG. 12 is a fragmentary section of the target support taken in the plane including line 12-12 of FIG. 11.

Referring now to FIGS. 11 and 12, the target support 12 comprises the post 22 and the first and second target support arms 24. Each target support arm 24 includes an upper jaw 90 (FIG. 1) for receiving a target or a target backer to which a target can be secured (e.g., fastened or adhered). The jaws 90 are formed to frictionally engage opposite faces of the target or backer to hold left and right sides of the target or backer.

The target support arms 24 are releasably connectable to a head of the post 22. Each target support arm 24 has a lower connection portion at which the target support arm bends about 90 degrees between a first arm segment 24A and a second arm segment 24B. An upper end of the post 22 defines a head including first and second sockets 92 for receiving the lower connection portions of the target support arms 24. As shown in FIG. 12, the sockets 92 each include a first section 92A arranged to receive the first arm segment 24A and a second section 92B arranged to receive the second arm segment 24B. When the connection portion of the arm is received in the respective socket 92, the first arm segment 24A extends downward into the head of the post 22 generally parallel with the axis of rotation A1, and the second arm segment 24B extends transversely with respect to the axis of rotation. Each socket 92 includes at least one detent 92C arranged to engage the second arm segment 24B when the second arm segment is received in the second section 92B of the socket. In the illustrated embodiment, each socket 92 includes opposing detents 92C on opposite sides of the second section 92B of the socket. The gap between the detents 92C is smaller than the width of the second arm segments 24B such that the arms "snap" into the sockets 92 when they pass the detents. The second sections 92B of the sockets 92 are sized to have depths smaller than the thickness of the second arm segments 24B, such that the detents 92C bias the second arm segments downward into the sockets. The arrangement is such that a stable, tight, and releasable connection of the target support arms 24 is provided. The target support arms 24 can be removed from the post 22 for storage by applying upward pressure to the arms to move the second arm segments 24B upward past the detents 92C.

In view of the description above, it will be understood methods of manufacturing the target turner 10 can include assembling two or more of the components described above, and methods of using the target turner can include one or more steps of setting up the target turner and/or operating the target turner.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A target turner comprising:

a target support including a target holder configured to hold a target;

a base including a housing, the base being configured to engage a support surface and to support the target with respect to the support surface, the target support being rotatable with respect to the base about a target turning axis; and a turning assembly supported by the base and operatively connectable to the target support for turning the target support about the target turning axis, the turning assembly including a motor and a drive train, the motor including an output shaft operatively connected to the drive train, the motor configured to rotate the output shaft about a first axis of rotation in a first direction of rotation, the drive train configured to, in response to rotation of the output shaft in the first direction of rotation, turn the target support in a first turning direction about the target turning axis from a non-shooting orientation to a shooting orientation and to, in response to further rotation of the output shaft in the first direction of rotation, turn the target support in a second turning direction opposite the first turning direction about the target turning axis from the shooting orientation to the non-shooting orientation, wherein the target turning axis extends into the housing and a portion of the turning assembly in the housing pivots about the target turning axis in response to rotation of the output shaft;

wherein the drive train includes a crank, a first turning member, and a second turning member, the crank being rotatable about a second axis of rotation responsive to rotation of the output shaft, the second turning member being rotatable about a third axis of rotation responsive to rotation of the crank, the crank including an actuator configured to turn the second turning member responsive to turning of the crank, wherein the first, second, and third axes of rotation are different from each other;

wherein the second turning member is configured to turn intermittently while the output shaft rotates in the first direction of rotation, the second turning member including a first set of gear teeth and the first turning member including a second set of gear teeth arranged to mesh with the first set of gear teeth so that the first and second sets of gear teeth move in mesh responsive to the output shaft rotating in the first direction of rotation.

2. A target turner as set forth in claim 1, wherein, in response to continuous rotation of the output shaft in the first direction of rotation, the drive train is configured to turn the target support in the first turning direction to the shooting orientation and turn the target support in the second turning direction to the non-shooting orientation.

3. A target turner as set forth in claim 1, wherein the drive train is configured to convert continuous rotation of the output shaft in the first direction to intermittent, alternating turning of the target support in the first turning direction and in the second turning direction.

4. A target turner as set forth in claim 1, wherein the base includes at least three legs for contacting the support surface, the legs being pivotable with respect to the housing between an operational position and a stowed position.

5. A target turner as set forth in claim 1, wherein the drive train is configured to turn the target support about 90 degrees in the first turning direction to the shooting orientation and turn the target support about 90 degrees in the second turning direction to the non-shooting orientation.

6. A target turner as set forth in claim 1, wherein the portion of the turning assembly in the housing comprises the second turning member.

7. A target turner as set forth in claim 6, wherein the housing houses all of the turning assembly.

8. A target turner as set forth in claim 1, wherein said portion of the turning assembly comprises a target support connector configured to form a connection with the target support.

9. A target turner as set forth in claim 8, wherein said portion of the turning assembly further comprises the second turning member.

10. A target turner as set forth in claim 1, wherein the first turning member comprises a first turning wheel and the second turning member comprises a second turning wheel, the crank being configured to alternately contact the first and second turning wheels with the actuator in response to rotation of the output shaft.

11. A target turner as set forth in claim 1, wherein the third axis of rotation is the target turning axis.

12. A target turner comprising:

a target support including a target holder configured to hold a target;

a base including a housing, the base being configured to engage a support surface and to support the target with respect to the support surface, the target support being rotatable with respect to the base about a target turning axis; and a turning assembly supported by the base and operatively connectable to the target support for turning the target support about the target turning axis, the turning assembly including a motor and a drive train, the motor including an output shaft operatively connected to the drive train, the motor configured to rotate the output shaft in a first direction of rotation, the drive train configured to, in response to rotation of the output shaft in the first direction of rotation, transmit force from the output shaft to the target support so that force from the output shaft turns the target support in a first turning direction about the target turning axis from a non-shooting orientation toward a shooting orientation and the drive train is configured to, in response to further rotation of the output shaft in the first direction of rotation after the target support is in the shooting orientation, transfer force received from the output shaft after the target support is in the shooting orientation to the target support to turn the target support in a second turning direction opposite the first turning direction about the target turning axis from the shooting orientation toward the non-shooting orientation, wherein the target turning axis extends into the housing and a portion of the turning assembly in the housing pivots about the target turning axis in response to rotation of the output shaft;

wherein the drive train includes a first turning body, the first turning body being arranged with respect to the output shaft such that force from the output shaft is transmitted to the first turning body so that force from the output shaft turns the first turning body in a first turning body direction to turn the target support in the first turning direction, and the first turning body being arranged with respect to the output shaft such that force from the output shaft is transmitted to the first turning body so that force from the output shaft turns the first turning body in a second turning body direction opposite the first turning body direction to turn the target support in the second turning direction.

13. A target turner as set forth in claim 12, wherein the drive train includes a second turning body, the first and second turning bodies configured to turn intermittently while the output shaft rotates in the first direction of rotation.

14. A target turner as set forth in claim 13, wherein the drive train includes a crank having a turning body actuator, and the first and second turning bodies include respective drive slots in which the turning body actuator is receivable for engaging and turning the turning bodies.

15. A target turner as set forth in claim 14, wherein the crank includes a lock configured to prevent the turning bodies from turning when the turning body actuator is not in one of the drive slots.

16. A target turner as set forth in claim 14, wherein the crank and first and second turning bodies are arranged with respect to each other such that continuous rotation of the crank causes the turning body actuator to alternately enter the first and second drive slots to alternately drive the first and second turning bodies.

17. A target turner as set forth in claim 16, wherein the first and second turning bodies are configured to turn conjointly and in inverse turning directions with respect to each other.

18. A target turner as set forth in claim 13, wherein the first and second turning bodies are configured to turn conjointly and in inverse turning directions with respect to each other.

19. A target turner as set forth in claim 12, wherein the drive train is free of a spring arranged to transfer force imparted by the output shaft to turn the target support from the shooting orientation to the non-shooting orientation and from the non-shooting orientation to the shooting orientation.

20. A target turner comprising:

a target support including a target holder configured to hold a target;

a base configured to engage a support surface and to support the target with respect to the support surface, the target support being rotatable with respect to the base about a target turning axis; and a turning assembly supported by the base and operatively connectable to the target support for turning the target support about the target turning axis, the turning assembly including a motor and a drive train, the motor including an output shaft operatively connected to the drive train, the motor configured to rotate the output shaft in a first direction of rotation, the drive train configured to, in response to rotation of the output shaft in the first direction of rotation, turn the target support in a first turning direction about the target turning axis from a non-shooting orientation to a shooting orientation and to, in response to further rotation of the output shaft in the first direction of rotation, turn the target support in a second turning direction opposite the first turning direction about the target turning axis from the shooting orientation to the non-shooting orientation;

wherein the drive train includes first and second turning bodies configured to turn intermittently while the output shaft rotates in the first direction of rotation;

wherein the first and second turning bodies are configured to turn conjointly and in inverse turning directions with respect to each other;

wherein the first and second turning bodies have gear teeth, the gear teeth of the first turning body being meshed with the gear teeth of the second turning body.

21. A target turner comprising:

a target support including a target holder configured to hold a target;

a base configured to engage a support surface and to support the target with respect to the support surface, the target support being rotatable with respect to the base about a target turning axis; and a turning assembly supported by the base and operatively connectable to the target support for turning the target support about the target turning axis, the turning assembly including a motor and a drive train, the motor including an output shaft operatively connected to the drive train, the motor configured to rotate the output shaft in a first direction of rotation, the drive train configured to, in response to rotation of the output shaft in the first direction of rotation, turn the target support in a first turning direction about the target turning axis from a non-shooting orientation to a shooting orientation and to, in response to further rotation of the output shaft in the first direction of rotation, turn the target support in a second turning direction opposite the first turning direction about the target turning axis from the shooting orientation to the non-shooting orientation;

wherein the drive train includes a turning mechanism;

wherein the turning mechanism includes first and second turning bodies and a crank, the crank being configured to rotate about a crank axis to drive turning of the first and second turning bodies, the first and second turning bodies being mounted for turning about respective first and second turning axes, the first and second turning axes located on opposite sides of the crank axis.

22. A target turner as set forth in claim 21, wherein the crank is constructed to alternately drivingly contact the first and second turning bodies in response to rotation of the output shaft.

23. A target turner comprising:

a target support configured to hold a target, the target support including a post having a lower end;

a base configured to engage a support surface and to support the target support for supporting the target with respect to the support surface;

a turning driver supported by the base and operatively connectable to the target support to apply a turning force to the target support to turn the target support about a target turning axis, the turning driver including a target support connector for connecting the target support to the turning driver; and at least one of the lower end of the post and the target support connector of the turning driver comprising a protrusion, and the other of the at least one of the lower end of the post and the target support connector of the turning driver comprising a recess, the protrusion receivable in the recess to form a joint for connecting the target support to the turning driver for conjoint turning of the protrusion and recess in response to the turning force applied by the turning driver, the recess and protrusion configured to dislocate the joint to disconnect the target support and turning driver in response to a force applied to the target support in opposition to the turning force;

wherein the protrusion extends along a protrusion axis to a free end of the protrusion, the protrusion including at least first and second planar side surfaces extending in different planes, the first and second planar side surfaces tapering toward the protrusion axis as the protrusion extends toward the free end.

24. A target turner as set forth in claim 23, wherein the recess includes first and second planar surfaces corresponding to and arranged to engage respective ones of the first and second planar side surfaces of the protrusion when the protrusion is received in the recess to form the joint.

25. A target turner as set forth in claim 23, wherein the first and second planar side surfaces are located adjacent each other and connected by a rounded corner.

26. A target turner comprising:

a target support including a target holder configured to hold a target;

a base including a housing, the base being configured to engage a support surface and to support the target with respect to the support surface, the target support being rotatable with respect to the base about a target turning axis; and a turning assembly supported by the base and operatively connectable to the target support for turning the target support about the target turning axis, the turning assembly including a motor and a drive train, the motor including an output shaft operatively connected to the drive train, the motor configured to rotate the output shaft about a first axis of rotation in a first direction of rotation, the drive train configured to, in response to rotation of the output shaft in the first direction of rotation, turn the target support in a first turning direction about the target turning axis from a non-shooting orientation to a shooting orientation and to, in response to further rotation of the output shaft in the first direction of rotation, turn the target support in a second turning direction opposite the first turning direction about the target turning axis from the shooting orientation to the non-shooting orientation, wherein the target turning axis extends into the housing and a portion of the turning assembly in the housing pivots about the target turning axis in response to rotation of the output shaft;

wherein the drive train includes a first turning body, a crank and a lock, the crank being arranged to rotate about a crank axis of rotation responsive to rotation of the output shaft in the first direction of rotation to transmit force from the output shaft to the target support to turn the target support, the crank including an actuator configured to rotate about the crank axis to transmit force from the crank to the target support for turning the target support, the first turning body being arranged with respect to the crank such that force from the output shaft is transmitted to the first turning body via the actuator of the crank so that force from the output shaft turns the first turning body to turn the target support, the lock being connected to the crank and arranged to rotate with the crank about the crank axis of rotation, the lock arranged to selectively block the target support from moving out of at least one of the non-shooting orientation or the shooting orientation via engagement of the lock with the first turning body, the lock being different from the actuator, wherein the crank axis of rotation is different from and spaced apart from the target turning axis;

wherein the crank axis of rotation is different from and spaced apart from the first axis of rotation.

27. A target turner as set forth in claim 26, wherein the first turning body is arranged with respect to the crank such that force from the output shaft is transmitted to the first turning body via the crank so that force from the output shaft turns the first turning body in a first turning body direction to turn the target support in the first turning direction, and the first turning body being arranged with respect to the crank such that force from the output shaft is transmitted to the first turning body via the crank so that force from the output shaft turns the first turning body in a second turning body direction opposite the first turning body direction to turn the target support in the second turning direction.

28. A target turner as set forth in claim 27, wherein the actuator of the crank is arranged to contact the first turning body to drive turning of the first turning body in at least the first turning body direction or the second turning body direction responsive to rotation of the output shaft.

29. The target turner of claim 26, wherein the lock is arranged such that during one rotation of the lock about the crank axis of rotation the lock establishes a first lock of the target support in at least one of the non-shooting orientation or the shooting orientation, a first unlock of the target support from at least one of the non-shooting orientation or the shooting orientation after the first lock, a second lock of the target support in at least one of the non-shooting orientation or the shooting orientation after the first unlock, and a second unlock of the target support from at least one of the non-shooting orientation or the shooting orientation after the second lock.

30. The target turner of claim 26, wherein the lock includes a first locking surface arranged to lock the target support in at least one of the non-shooting orientation or the shooting orientation and a second locking surface arranged to lock the target support in at least one of the non-shooting orientation or the shooting orientation, the first locking surface and the second locking surface being spaced apart and disposed on generally opposite sides of the crank axis of rotation.

31. A target turner comprising:

a target support including a target holder configured to hold a target;

a base configured to engage a support surface and to support the target with respect to the support surface, the target support being rotatable with respect to the base about a target turning axis; and a turning assembly supported by the base and operatively connectable to the target support for turning the target support about the target turning axis, the turning assembly including a motor and a drive train, the motor including an output shaft operatively connected to the drive train, the motor configured to rotate the output shaft in a first direction of rotation, the drive train configured to, in response to rotation of the output shaft in the first direction of rotation, transmit force from the output shaft to the target support so that force from the output shaft turns the target support in a first turning direction about the target turning axis from a non-shooting orientation toward a shooting orientation and the drive train is configured to, in response to further rotation of the output shaft in the first direction of rotation after the target support is in the shooting orientation, transfer force received from the output shaft after the target support is in the shooting orientation to the target support to turn the target support in a second turning direction opposite the first turning direction about the target turning axis from the shooting orientation toward the non-shooting orientation;

wherein the drive train includes first and second turning bodies configured to turn intermittently while the output shaft rotates in the first direction of rotation, the first turning body being rotatable about a first axis of rotation responsive to rotation of the output shaft, the second turning body being rotatable about a second axis of rotation responsive to rotation of the output shaft, the first and second axes of rotation being different from each other, wherein the first and second turning bodies engage one another when the target support is in the shooting orientation and the non-shooting orientation.

* * * * *